US008810469B2

(12) United States Patent
Kim

(10) Patent No.: US 8,810,469 B2
(45) Date of Patent: Aug. 19, 2014

(54) BUILT-IN ANTENNA WHICH SUPPORTS BROADBAND IMPEDANCE MATCHING AND HAS FEEDING PATCH COUPLED TO SUBSTRATE

(75) Inventor: Byong-Nam Kim, Kyeonggi-Do (KR)

(73) Assignee: Ace Technologies Corporation, Incheon (KR)

( * ) Notice: Subject to any disclaimer, the term of this patent is extended or adjusted under 35 U.S.C. 154(b) by 426 days.

(21) Appl. No.: 13/139,431

(22) PCT Filed: Mar. 30, 2009

(86) PCT No.: PCT/KR2009/001604

§ 371 (c)(1),
(2), (4) Date: Jun. 13, 2011

(87) PCT Pub. No.: WO2010/071265

PCT Pub. Date: Jun. 24, 2010

(65) Prior Publication Data

US 2011/0241964 A1 Oct. 6, 2011

(30) Foreign Application Priority Data

Dec. 18, 2008 (KR) ..... 10-2008-0129669

(51) Int. Cl.
*H01Q 1/48* (2006.01)

(52) U.S. Cl.
USPC ..... 343/846

(58) Field of Classification Search
USPC ..... 343/700 MS, 722, 846
See application file for complete search history.

(56) References Cited

U.S. PATENT DOCUMENTS

| | | | | |
|---|---|---|---|---|
| 5,861,854 | A | 1/1999 | Kawahata et al. | |
| 6,650,294 | B2 * | 11/2003 | Ying et al. | 343/700 MS |
| 7,161,541 | B2 * | 1/2007 | Chen | 343/700 MS |
| 7,432,860 | B2 * | 10/2008 | Huynh | 343/700 MS |
| 7,808,442 | B2 * | 10/2010 | Chiu et al. | 343/826 |
| 2004/0051665 | A1 | 3/2004 | Chen | |
| 2004/0113845 | A1 | 6/2004 | Mikkola et al. | |
| 2008/0180333 | A1 | 7/2008 | Martiskainen et al. | |

FOREIGN PATENT DOCUMENTS

| | | |
|---|---|---|
| JP | 10-013139 A | 1/1998 |
| KR | 10-799875 | 1/2008 |

* cited by examiner

*Primary Examiner* — Seung Lee
(74) *Attorney, Agent, or Firm* — Edwards Wildman Palmer LLP; Kongsik Kim; Stephen D. LeBarron

(57) ABSTRACT

Disclosed is an internal antenna providing impedance matching for a wide band where a feeding patch is placed on a substrate. The disclosed antenna may include: a substrate; an impedance matching/feeding unit including a feeding patch, which is formed on the substrate and electrically connected to a feeding point, and a ground patch, which is electrically connected to a ground and formed above the feeding patch separated at a designated distance from the feeding patch; and a radiator formed extending from the ground patch, where the impedance matching/feeding unit performs impedance matching by way of coupling between the feeding patch and the ground patch, and the radiator receives coupling feeding from the feeding patch. The disclosed antenna has the advantages of overcoming the narrow band problem of a planar inverted-F antenna, and of allowing more efficient utilization of space in an internal antenna for a wide band using coupling matching and coupling feeding.

9 Claims, 8 Drawing Sheets

BUILT-IN ANTENNA WHICH SUPPORTS BROADBAND IMPEDANCE MATCHING AND HAS FEEDING PATCH COUPLED TO SUBSTRATE

CROSS-REFERENCES TO RELATED APPLICATIONS

This application is a U.S. national phase application, pursuant to 35 U.S.C. §371, of PCT/KR2009/001604, filed Mar. 30, 2009, designating the United States, which claims priority to Korean Application No. 10-2008-0129669, filed Dec. 18, 2008. The entire contents of the aforementioned patent applications are incorporated herein by this reference.

TECHNICAL FIELD

The present invention relates to an antenna, more particularly to an internal antenna providing impedance matching for a wide band.

BACKGROUND ART

Recently there has been a demand for the ability to receive mobile communication services of different frequency bands through one mobile communication terminal, even as mobile communication terminals become smaller and lighter. There is a demand for terminals that are able to use signals of multiple bands simultaneously as necessary, for mobile communication services using a variety of frequency bands such as, for example, the CDMA service of the 824-894 MHz band and the PCS service of the 1750-1870 MHz, which have been commercialized in Korea, the CDMA service of the 832-925 MHz band, which has been commercialized in Japan, the PCS service of the 1850-1990 MHz band, which has been commercialized in the U.S., the GSM service of the 880-960 MHz band, which has been commercialized in Europe and China, and the DCS service of the 1710-1880 MHz band, which has been commercialized in parts of Europe; for accommodating such multiple bands there is a demand for an antenna having wide band characteristics.

Besides these, there is also a demand for composite terminals that are able to use services such as Bluetooth, ZigBee, wireless LAN, GPS, etc. In such a terminal for using services of multiple bands, a multiple band antenna should be used that is able to operate in two or more bands. For an antenna of a generally used mobile communication terminal, a helical antenna and a planar inverted-F antenna (PIFA) are mainly used.

Here, a helical antenna is an external antenna affixed to the top end of a terminal, and is used together with a monopole antenna. A helical and monopole antenna in combined usage is such that if the antenna is extended out of the body of the terminal, it acts as a monopole antenna, and if it is retracted, it acts as a $\lambda/4$ helical antenna. Such an antenna has the advantage of high profits, but due to its non-directivity, the SAR (specific absorption rate)—the standard for the level of harmfulness of electromagnetic waves to the human body—is not good. Also, as a helical antenna is constructed as protruding out of a terminal, it is not easy to provide an esthetic appearance and an external design suitable to portability of the terminal, and no study has been done on an internal structure with regards to this.

An inverted-F antenna is an antenna designed with a low profile structure for the purpose of overcoming such disadvantages. An inverted-F antenna has a directivity that improves its SAR by reducing the beams emitted towards the human body, left over from the beams going toward the ground, out of all the beams generated by the current left in the radiating part, while at the same time strengthening the beams left to go in the direction of the radiating part; and it may also be implemented as a low profile structure operating with a square micro-strip antenna, the length of the rectangular flat-board radiating part being reduced in half.

Since such an inverted-F antenna has radiating characteristics with a directivity that reduces the strength of beams going toward the human body and fortifies the strength of the beams going outward from the body, it has a superior electromagnetic specific absorption rate when compared with a helical antenna. However, an inverted-F antenna has the problem of having a narrow frequency band width.

The narrow frequency band width of an inverted-F antenna is due to point-matching, in which the matching with a radiator takes place at a specific point.

In order to overcome the problem related to a narrow band width due to point matching, an application was submitted for a Korean patent by the inventor, and this application presents a structure that overcomes the problem of a narrow band width of the existing inverted-F antenna by means of coupling matching and coupling feeding in a comparatively long interval.

However, there was the problem of the size of the antenna being large, as a separate impedance matching part for such coupling matching and coupling feeding occupied a comparatively large space.

DISCLOSURE

Technical Problem

To resolve the problem of the related art addressed above, an aspect of the invention provides an internal antenna for a wide band for the purpose of overcoming the narrow band problem of a planar inverted-F antenna.

Another objective of the present invention is to provide an internal antenna for a wide band that utilizes space more efficiently than an internal antenna for a wide band that uses coupling matching and coupling feeding.

Other objectives of the present invention can readily be derived by those skilled in the art from the embodiments below.

Technical Solution

To achieve the objective above, an aspect of the invention provides an internal antenna providing impedance matching for a wide band that includes a substrate; an impedance matching/feeding unit including a feeding patch, which is formed on the substrate and electrically connected to a feeding point, and a ground patch, which is electrically connected to a ground and formed above the feeding patch separated at a designated distance from the feeding patch; and a radiator formed extending from the ground patch, where the impedance matching/feeding unit performs impedance matching by way of coupling between the feeding patch and the ground patch, and coupling feeding is provided to the radiator from the feeding patch.

The antenna may further include a ground pin that is formed on the substrate, electrically connected to a ground, and formed perpendicular to the substrate so as to be connected to a ground patch separated at a designated distance from the substrate.

The ground patch may have a slot formed in its center part.

The area of the ground patch may be set greater than the area of the feeding patch.

The antenna may further include a carrier to which the ground patch and the radiator are joined and secured.

A ground patch joining part for joining with the ground patch may be formed on a portion of a lower part of the carrier, and the ground patch joining part may be separated at a designated distance from the substrate.

A slot may be formed in the ground patch joined to the ground patch joining part, and a support part may be formed on the carrier, with the support part protruding through the slot and contacting the feeding patch on the substrate to thereby support the carrier on the substrate.

The radiator may extend to a side part and a flat upper part of the carrier.

Another aspect of the invention provides an internal antenna providing impedance matching for a wide band that includes a substrate; a carrier joined to the substrate and having a portion of its lower part separated from the substrate by a designated distance; a feeding patch formed on the substrate and electrically connected to a feeding point; a ground patch which is joined to the portion of the lower part of the carrier separated at a designated distance from the substrate and which is formed above the feeding patch; and a radiator extending from the ground patch and formed on a side part and a flat upper part of the carrier.

Advantageous Effects

An embodiment of the present invention offers the advantages of overcoming the narrow band problem of a planar inverted-F antenna, and of allowing more efficient utilization of space in an internal antenna.

MODE FOR INVENTION

An internal antenna providing impedance matching for a wide band according to an embodiment of the invention will be described below in more detail with reference to the accompanying drawings.

An internal antenna providing impedance matching for a wide band according to an embodiment of the invention may be implemented with the use of a carrier, but for the sake of ease of explanation, first a description will be given of an antenna having a structure without a carrier with reference to FIGS. 1 to 4, and then later a description will be given of a structure implemented with a carrier.

Figure 1:
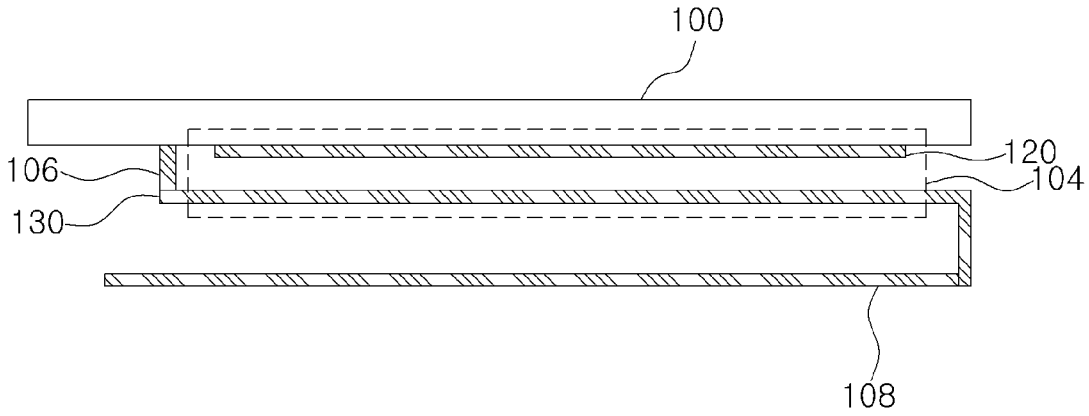
FIG. 1 is a cross-sectional view of an internal antenna for a wide band according to an embodiment of the present invention.
Figure 2:
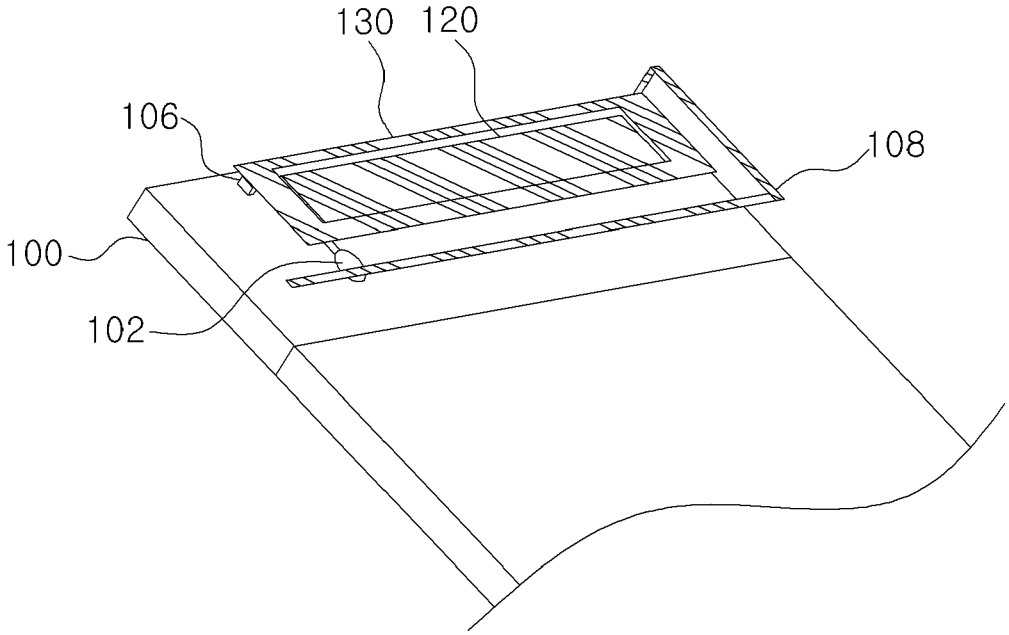
FIG. 2 is a perspective view of an internal antenna for a wide band according to an embodiment of the present invention.
Figure 3:
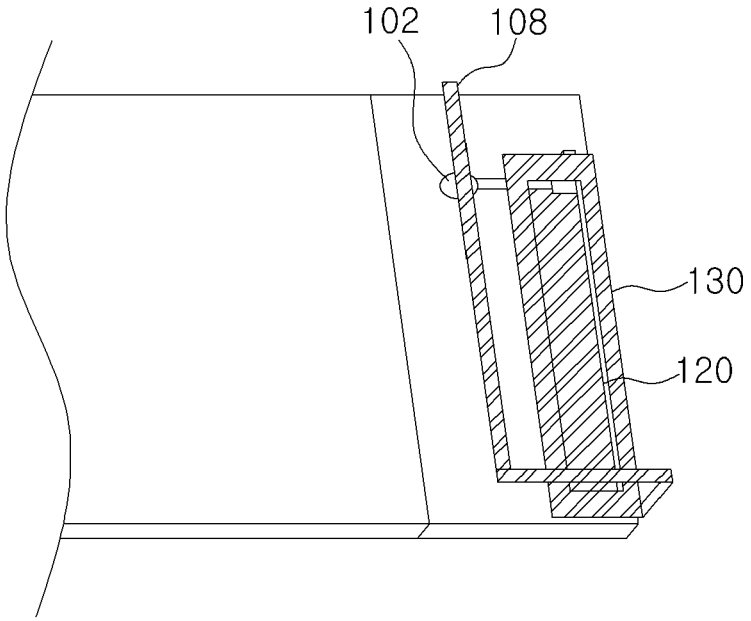
FIG. 3 is a perspective view of the internal antenna for a wide band according to an embodiment of the present invention as seen from another direction.
Figure 4:
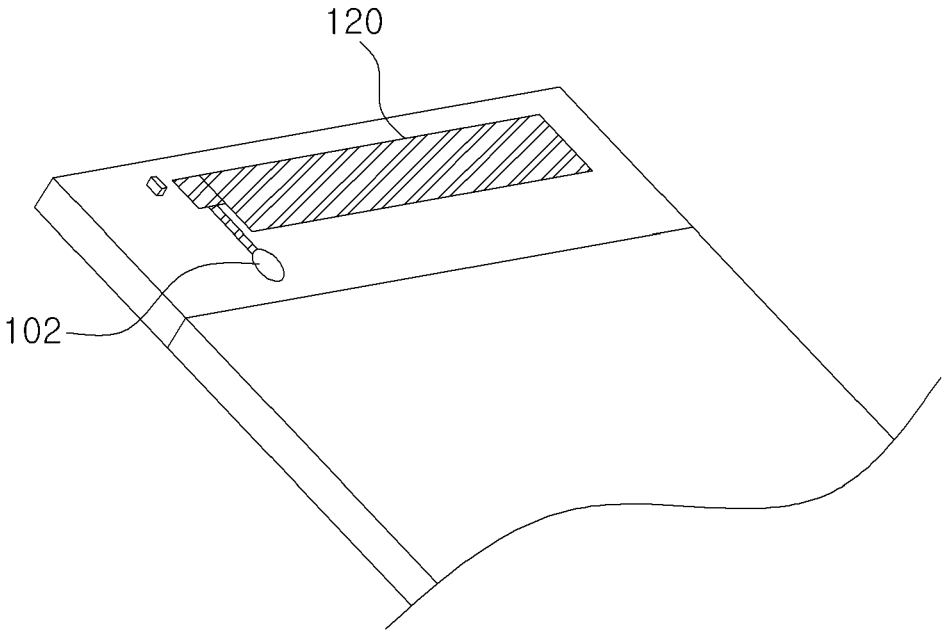
FIG. 4 illustrates only a feeding part and a feeding patch formed on the substrate of an internal antenna for a wide band according to an embodiment of the present invention.

FIG. 1 is a cross-sectional view of an internal antenna for a wide band according to an embodiment of the present invention, FIG. 2 is a perspective view of an internal antenna for a wide band according to an embodiment of the present invention, and FIG. 3 is a perspective view of the internal antenna for a wide band according to an embodiment of the present invention as seen from another direction, while FIG. 4 illustrates only a feeding part and a feeding patch formed on the substrate of an internal antenna for a wide band according to an embodiment of the present invention.

Referring to FIGS. 1 to 3, an internal antenna providing impedance matching for a wide band according to an embodiment of the present invention may comprise a substrate 100, a feeding point 102, an impedance matching/feeding unit 104, a ground pin 106, and a radiator 108. Here, the impedance matching unit 104 comprises a feeding patch 120 and a ground patch 130.

The feeding point 102 is formed on the substrate 100, and RF signals are input to the feeding point 102. The feeding point 102 is electrically connected to the feeding patch 120 of the impedance matching/feeding unit 104.

As illustrated in FIG. 4, the feeding patch 120 is formed on the substrate 100, is electrically connected to the feeding point 102 while joined to the substrate, and may be rectangular in shape, but the feeding patch 120 is not limited to the above.

Referring to the cross-sectional view of FIG. 1, the ground patch 130 is placed above the feeding patch 120, separated at a designated distance from the feeding patch 120. The ground patch 130 is electrically connected to a ground of the terminal, and while FIG. 1 illustrates an example in which the ground patch 130 is electrically connected to the ground by the ground pin 106, the invention is not thus limited.

A description will be given later of a structure wherein an antenna according to an embodiment of the present invention is joined to a carrier, but the ground patch 130 may be secured at a designated distance from the feeding patch 120 by being attached to the antenna carrier.

The impedance matching/feeding unit 104 comprising the feeding patch 120 and the ground patch 130 performs impedance matching and coupling feeding for the antenna.

RF signals provided to the feeding patch 120 are coupled to the ground patch 130 that is separated at a designated distance, and the coupling thus achieved in a region of a designated length enables impedance matching for a wider band than does the conventional planar inverted-F antenna.

The feeding patch 120 and the ground patch 130 for impedance matching for a wide band should have a designated length, and may be set at approximately 0.1 wavelength, but this may be adjusted according to the frequency band and operating frequency.

Also, coupling feeding occurs at the impedance matching/feeding unit 140, where RF signals are transferred by coupling from the feeding patch 120 to the ground patch 130.

As illustrated in FIGS. 2 and 3, according to a preferred embodiment of the present invention, a slot is formed in a center part of the ground patch. The slot is formed for adjusting the coupling between the feeding patch 120 and the ground patch 130, and may be omitted as necessary. For providing matching for a wide band, capacitance for coupling should preferably be varied, and such a structure may be achieved by means of the slot.

The structure of the impedance matching/feeding unit 104 of the present invention which performs impedance matching and coupling feeding by way of the feeding patch 120 and the ground patch 130 separated at a designated distance is different from that of a typical planar inverted-F antenna, in which impedance matching is achieved at a specific point, and provides matching for a wider band.

The radiator 108 extends from the ground patch 130. While FIGS. 2 and 3 illustrate an example in which the radiator 108 extends from the ground patch 130 perpendicularly and then bends to be parallel with the substrate, the form of the radiator is not thus limited, and various forms may be used.

The length of the radiator 108 is set according to the frequency band used, and its type may also be set in a wide variety. While FIGS. 2 and 3 illustrate an "L" shaped configuration in which the portion of the radiator parallel to the substrate is bent once, a person skilled in the art would appreciate that such cases in which the portion parallel to the substrate is implemented in linear and meandering forms may also fall within the scope of the present invention.

Whereas in a typical planar inverted-F antenna, a radiator is electrically connected to a feeding pin since feeding is performed directly, in an antenna according to an embodiment of the present invention, feeding to the radiator 108 is performed by way of coupling because the radiator 108 extends from the ground patch.

Figure 5:
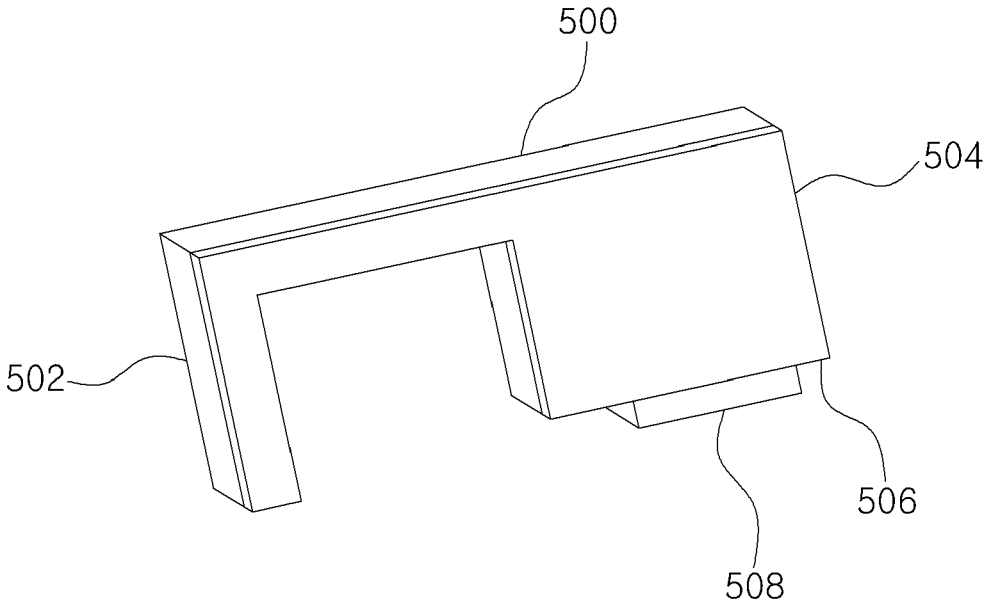
FIG. 5 illustrates an example of an antenna carrier to which an antenna may be joined according to an embodiment of the present invention.

FIG. 5 illustrates an example of an antenna carrier to which an antenna may be joined according to an embodiment of the present invention.

Referring to FIG. 5, an antenna carrier to which an antenna according to an embodiment of the present invention is joined may comprise a flat upper part 500, side wall parts 502, 504, a ground patch joining part 506, and a support part 508.

The flat upper part 500 is the part to which the radiator of the antenna is joined, and has a designated area.

A first side wall part 502 is formed on a first side of the carrier and joined to the substrate, and a second wall part 504 is formed on a second side of the carrier and separated from the substrate at a designated distance from the support part 508.

Figure 6:
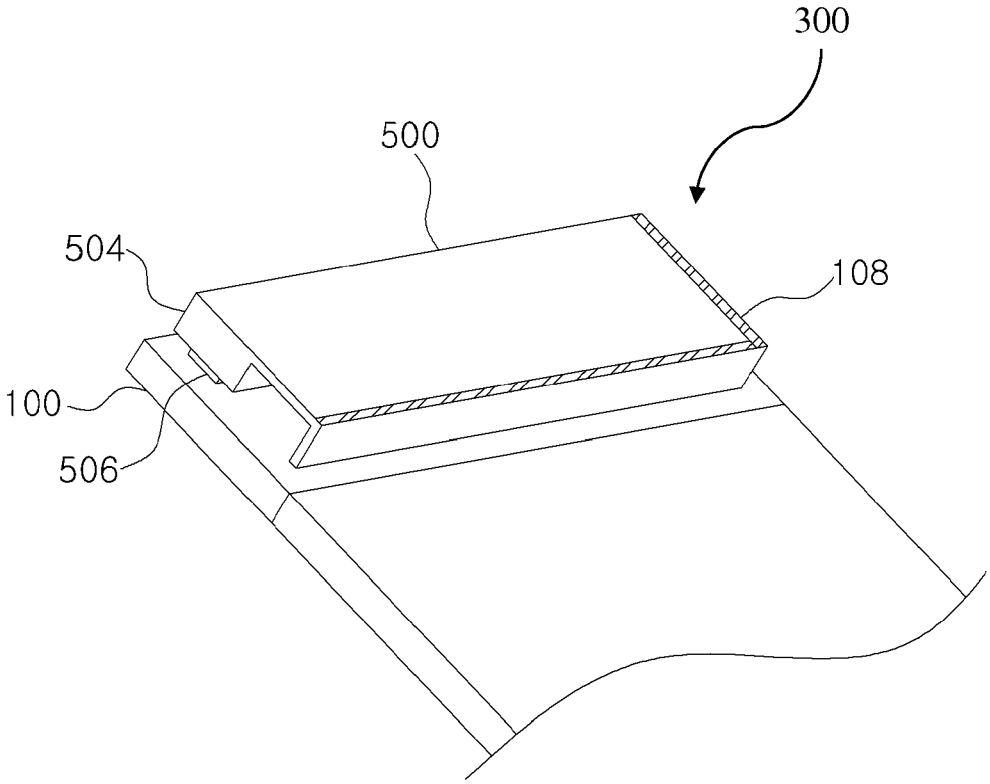
FIG. 6 is a perspective view of an antenna according to an embodiment of the present invention joined to the antenna carrier illustrated in FIG. 5.
Figure 7:
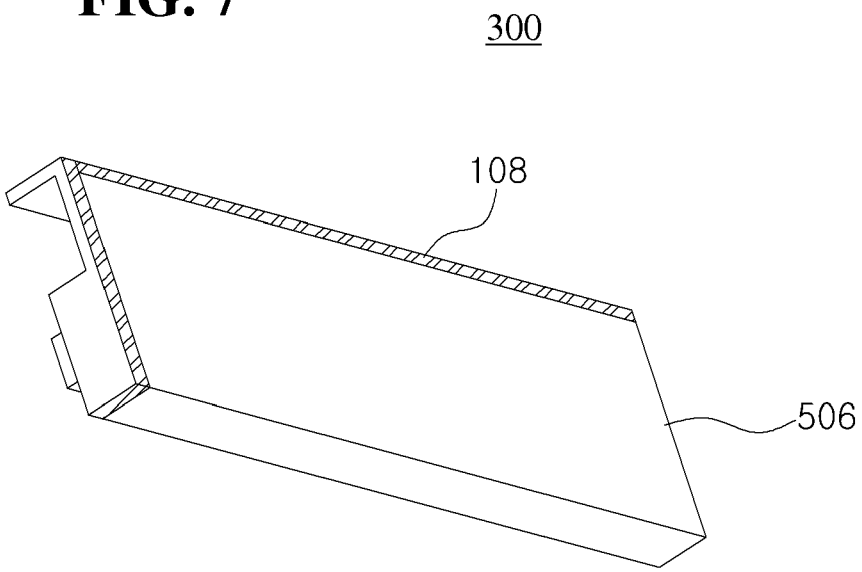
FIG. 7 is a perspective view of an antenna according to an embodiment of the present invention joined to the antenna carrier illustrated in FIG. 5 as seen from another direction.

FIG. 6 is a perspective view of an antenna according to an embodiment of the present invention joined to the antenna carrier illustrated in FIG. 5, and FIG. 7 is a perspective view of an antenna according to an embodiment of the present invention joined to the antenna carrier illustrated in FIG. 5 as seen from another direction. Also, FIG. 8 illustrates a ground patch joined to a ground patch joining part of the antenna carrier.

Figure 8:
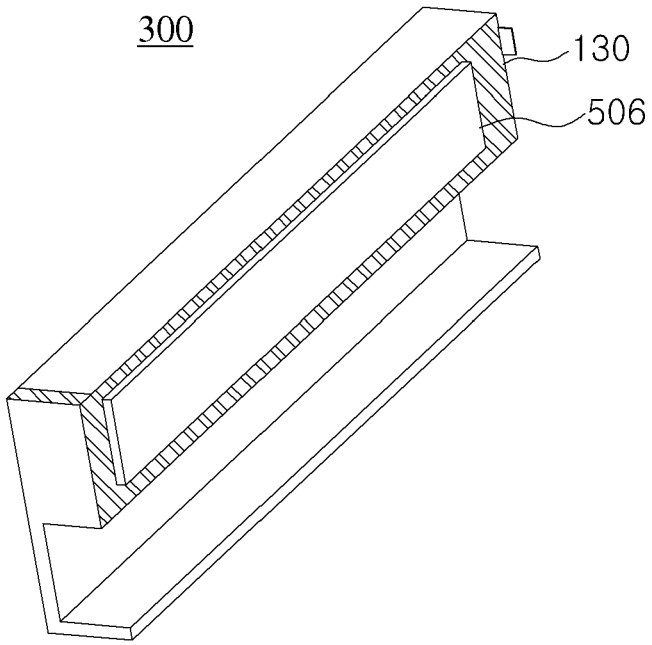
FIG. 8 illustrates a ground patch joined to a ground patch joining part of the antenna carrier.

Referring to FIGS. 6 to 8, the antenna carrier 300 is joined to the substrate, and the support part 508 is in contact with an upper part of the substrate. Here, according to a preferred embodiment of the present invention, the support part 508 is in contact with the feeding patch 120 on the substrate, and the area of the support part 508 should preferably be the same as or similar to that of the feeding patch 120.

Referring to FIG. 8, the ground patch 130 having a slot in its center part is joined to the ground patch joining part 506. As described above, the ground part 130 may also be electrically connected to the ground by way of a component such as a ground pin.

When an antenna carrier has the structure as in FIGS. 6 to 8, the ground part joined to the ground patch joining part 506 has a slot in its center, since the support part 508 is to protrude from the ground patch joining part 506. But, those skilled in the art would appreciate that the support part 508 may be in a variety of forms besides the structure shown in FIGS. 6 to 8, and in such cases, it is also possible to have a ground patch joined which is in the form of a patch having no slot in its center.

The feeding patch 120 formed on the substrate and the ground patch 130 joined to the ground patch joining part 506 are separated at a designated distance by the support part 508, achieving impedance matching and feeding by means of coupling.

The radiator electrically connected to the ground part 130 is formed on the second side wall part 504 and the flat upper part 500. A portion of the radiator joined to the second side wall part 504 is formed in a vertical direction, and a portion of the radiator formed on the flat upper part 500 is formed in a horizontal direction.

While a carrier generally has a radiator and a feeding part formed only on its upper part, an embodiment of the present invention can efficiently utilize the limited space within the terminal by having the feeding part and radiator formed on the lower, side, and upper parts of the carrier.

In particular, an embodiment of the present invention has a portion of the carrier separated at a designated distance from the substrate, and has a coupling space formed between the feeding part and the ground part by joining the ground part to the ground patch joining part at a lower part of the separated portion, thus maximizing the utilization of space in the antenna carrier and reducing the size of the antenna using coupling matching and feeding.

The invention claimed is:

1. An internal antenna providing impedance matching for a wide band, the antenna comprising:

a substrate;

an impedance matching/feeding unit comprising a feeding patch and a ground patch, the feeding patch formed on the substrate and electrically connected to a feeding point, the ground patch electrically connected to a ground and formed above the feeding patch separated at a designated distance from the feeding patch;

a radiator extending from the ground patch; and a carrier having the ground patch and the radiator joined and secured thereto, wherein the impedance matching/feeding unit performs impedance matching by way of coupling between the feeding patch and the ground patch, coupling feeding is provided to the radiator from the feeding patch, and wherein a ground patch joining part for joining with the ground patch is formed on a portion of a lower part of the carrier, and the ground patch joining part is separated at a designated distance from the substrate.

2. The internal antenna providing impedance matching for a wide band according to claim 1, further comprising:

a ground pin formed on the substrate and electrically connected to a ground, the ground pin formed perpendicular to the substrate so as to be connected to a ground patch separated at a designated distance from the substrate.

3. The internal antenna providing impedance matching for a wide band according to claim 1, wherein the ground patch has a slot formed in a center part thereof.

4. The internal antenna providing impedance matching for a wide band according to claim 3, wherein an area of the ground patch is set to be greater than an area of the feeding patch.

5. The internal antenna providing impedance matching for a wide band according to claim 1, wherein the ground patch joined to the ground patch joining part has a slot formed therein, and the carrier has a support part formed thereon, the support part protruding through the slot and contacting the feeding patch on the substrate to thereby support the carrier on the substrate.

6. The internal antenna providing impedance matching for a wide band according to claim 1, wherein the radiator extends to a side part and a flat upper part of the carrier.

7. An internal antenna providing impedance matching for a wide band, the antenna comprising:

a substrate;

a carrier joined to the substrate and having a portion of a lower part thereof separated at a designated distance from the substrate;

a feeding patch formed on the substrate and electrically connected to a feeding point;

a ground patch joined to the portion of the lower part of the carrier separated at a designated distance from the substrate and formed above the feeding patch; and a radiator extending from the ground patch and formed on a side part and a flat upper part of the carrier.

8. The internal antenna providing impedance matching for a wide band according to claim 7, wherein a coupling phenomenon occurs between the feeding patch and the ground patch, and impedance matching and coupling feeding are performed by way of the coupling.

9. The internal antenna providing impedance matching for a wide band according to claim 7, wherein the ground patch has a slot formed in a center part thereof.

* * * * *